US006913038B2

(12) United States Patent
Suzuki

(10) Patent No.: US 6,913,038 B2
(45) Date of Patent: Jul. 5, 2005

(54) PUMP FOR EXERTING PRESSURE ON FLUID AND FLUID TANK UNIT HAVING THE SAME

(75) Inventor: Shigeru Suzuki, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 3 days.

(21) Appl. No.: 10/265,987

(22) Filed: Oct. 7, 2002

(65) Prior Publication Data

US 2003/0068239 A1 Apr. 10, 2003

(30) Foreign Application Priority Data

Oct. 9, 2001 (JP) ..... 2001-311522

(51) Int. Cl.[7] ..... F02M 37/10
(52) U.S. Cl. ..... 137/565.17; 417/269; 417/415
(58) Field of Search ..... 417/269, 366, 417/423.8, 415, 902; 137/565.17

(56) References Cited

U.S. PATENT DOCUMENTS

| | | | | | |
|---|---|---|---|---|---|
| 2,510,632 | A | * | 6/1950 | Hemphill | 417/366 |
| 3,175,758 | A | * | 3/1965 | Dirk | 417/366 |
| 3,610,784 | A | * | 10/1971 | Rundell | 417/902 |
| 4,190,402 | A | * | 2/1980 | Meece et al. | 417/415 |
| 6,019,027 | A | * | 2/2000 | Furuya et al. | 417/269 |
| 6,447,270 | B1 | * | 9/2002 | Schmidt et al. | 417/366 |
| 6,565,329 | B2 | * | 5/2003 | Yokomachi et al. | 417/366 |
| 2003/0017057 | A1 | | 1/2003 | Suzuki et al. | |
| 2003/0020240 | A1 | | 1/2003 | Suzuki | |

FOREIGN PATENT DOCUMENTS

| | | |
|---|---|---|
| JP | 4-27157 | 3/1992 |
| JP | 4-57693 | 5/1992 |
| JP | 9-88807 | 3/1997 |
| JP | 10-68396 | 3/1998 |
| JP | 2000-320907 | 11/2000 |

* cited by examiner

*Primary Examiner*—Michael Koczo, Jr.
(74) *Attorney, Agent, or Firm*—Knoble Yoshida & Dunleavy LLC

(57) ABSTRACT

A pump exerts pressure on fluid that has higher saturation pressure than atmospheric pressure at room temperature in a fluid reserving chamber in a fluid tank. The pump is located near the fluid tank. The pump has a housing and a heat generating mechanism. The housing defines a pump chamber, a motor chamber and a communication passage between the pump chamber and the motor chamber and includes at least one introducing port for introducing the fluid from the fluid reserving chamber into the housing and a bleeding port located above the introducing port for returning the fluid from the housing to the fluid reserving chamber. The heat generating mechanism is located in the housing. The fluid circulates into the housing through the introducing port and out of the housing through the bleeding port for substantially reducing the temperature in the housing.

23 Claims, 4 Drawing Sheets

PUMP FOR EXERTING PRESSURE ON FLUID AND FLUID TANK UNIT HAVING THE SAME

BACKGROUND OF THE INVENTION

The present invention relates to a pump for exerting pressure on fluid and particularly relates to a circulation of the fluid through the pump.

Unexamined Japanese Patent Publication No. 9-88807 discloses a pump for exerting pressure on fluid. The pump has an integral structure that includes a hydraulic pump (a pump mechanism) and an electric motor (a motor mechanism) in the same unit housing. The pump also includes an oil passage for draining oil from the hydraulic pump into the electric motor side and then to the outside of the housing. Thus, the drain oil cools the electric motor. However, an introducing port for introducing oil from the outside of the housing into the inside is not provided, and only the drain oil drained from the pump cools the motor. Since cooling is performed only by the drain oil, cooling efficiency is relatively low.

Unexamined Japanese Utility Model Publication No. 4-57693 also discloses a fluid pump. The fluid pump includes a pump mechanism and a motor mechanism. The fluid pump also includes two communication passages bored through a casing of the fluid pump, and the communication passages are located adjacent to the motor mechanism. The fluid enters into the casing through one passage and exits through the other to cool the motor mechanism.

It is desired to obtain a pump for exerting pressure on fluid that efficiently cools a pump mechanism and a motor mechanism and to obtain a fluid tank unit with the above pump.

SUMMARY OF THE INVENTION

In accordance with the present invention, a pump exerts pressure on fluid that has higher saturation pressure than atmospheric pressure at room temperature in a fluid reserving chamber in a fluid tank. The pump is located near the fluid tank. The pump has a housing and a heat generating mechanism. The housing defines a pump chamber, a motor chamber and a communication passage between the pump chamber and the motor chamber and includes at least one introducing port for introducing the fluid from the fluid reserving chamber into the housing and a bleeding port located above the introducing port for returning the fluid from the housing to the fluid reserving chamber. The heat generating mechanism is located in the housing. The fluid circulates into the housing through the introducing port and out of the housing through the bleeding port for substantially reducing the temperature in the housing.

Also, In accordance with the present invention, a pump exerts pressure on fluid that has higher saturation pressure than atmospheric pressure at room temperature in a fluid reserving chamber in a fluid tank. The pump is located near the fluid tank. The pump has a housing, a pump mechanism and a motor mechanism. The housing defines a pump chamber, a motor chamber and a communication passage between the pump chamber and the motor chamber and includes an introducing port for introducing the fluid into the pump chamber and a bleeding port located above the introducing port for returning the fluid from the motor chamber to the fluid reserving chamber. The pump mechanism is located in the pump chamber for exerting pressure on the fluid. The pump mechanism generates heat. The motor mechanism is located in the motor chamber for driving the pump mechanism. The motor mechanism generates heat. The fluid carries the heat.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
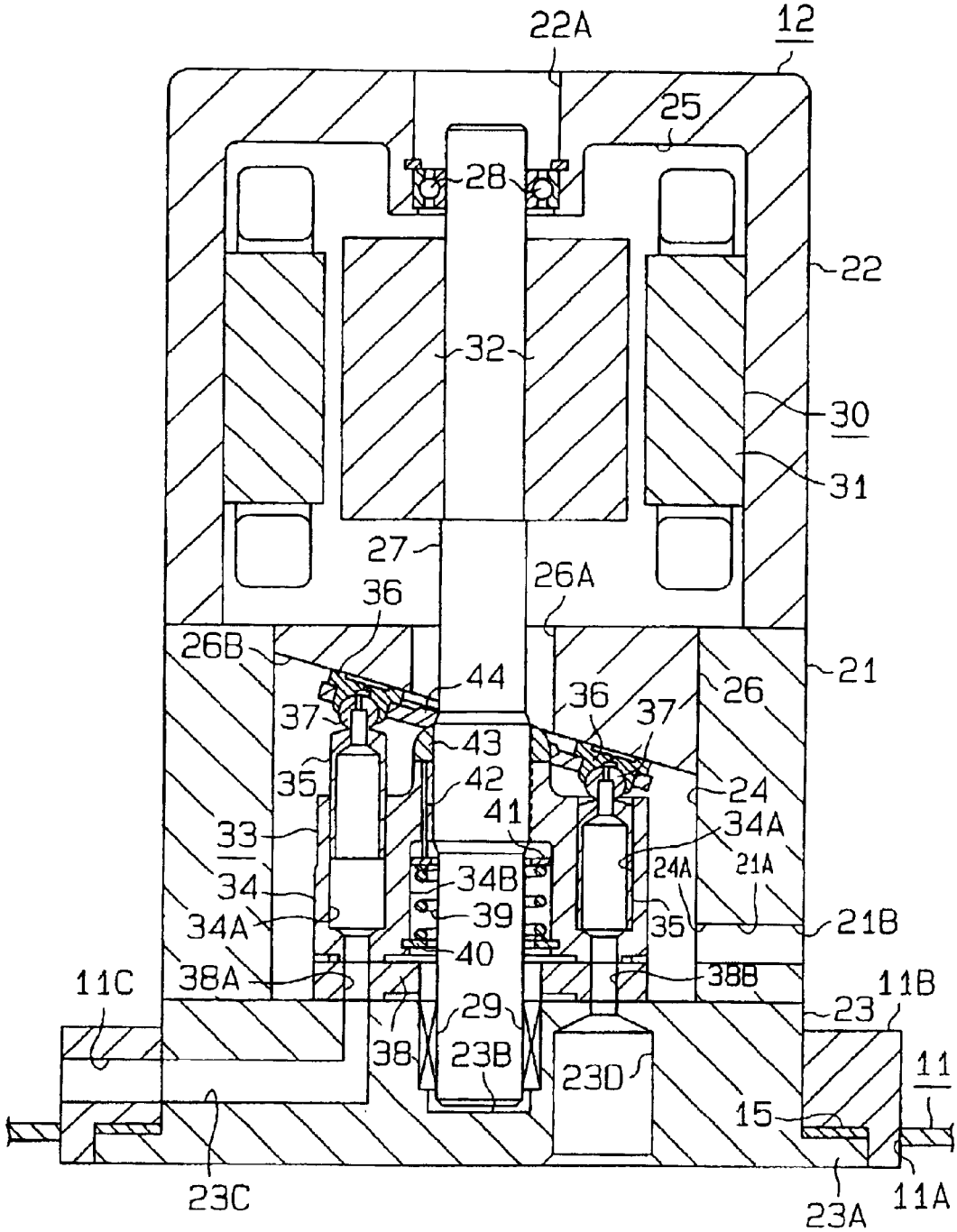
FIG. 1 is a schematic cross-sectional view of a fuel pump according to a first embodiment of the present invention.

A first embodiment of the present invention will now be described with reference to FIGS. 1 and 2. FIG. 2 is a schematic view of a fluid fuel supply system for supplying a fuel injection device F with dimethylether fuel (DME fuel) or fluid. The fuel injection device F is connected to a diesel type internal combustion engine E which is a drive source of a vehicle. This fluid fuel supply system includes a fuel tank 11 and a fuel pump 12. The fuel tank 11 functions as a fluid tank to reserve the DME. The fuel pump 12 is placed in the fuel tank 11 and functions as a pump for exerting pressure on the fluid to supply the fuel injection device F with the DME in the liquid form from the fuel tank 11. The above-mentioned DME has higher saturation pressure than atmospheric pressure at room temperature. When an inlet 16 for pouring the DME into the fuel tank 11 is closed, the fuel tank 11 isolates the inside space of the tank 11 and maintains its inside pressure independent from the outside pressure. The fuel tank 11 and the fuel pump 12 constitute a fuel tank unit or a fluid tank unit.

The fuel pump 12 is substantially accommodated in the fuel tank 11. The fuel pump 12 is fixed to the bottom end of the fuel tank 11. The fuel pump 12 communicates with the fuel injection device F through a supply conduit 13 for supplying the fuel injection device F with the DME discharged from the fuel pump 12. The fuel injection device F communicates with the fuel tank 11 through a return conduit 17 to the fuel tank 11. The redundant DME, which was supplied from the fuel pump 12 to the fuel injection device F, but was not fully utilized by the fuel injection device F, returns through the return conduit 17.

Figure 2:
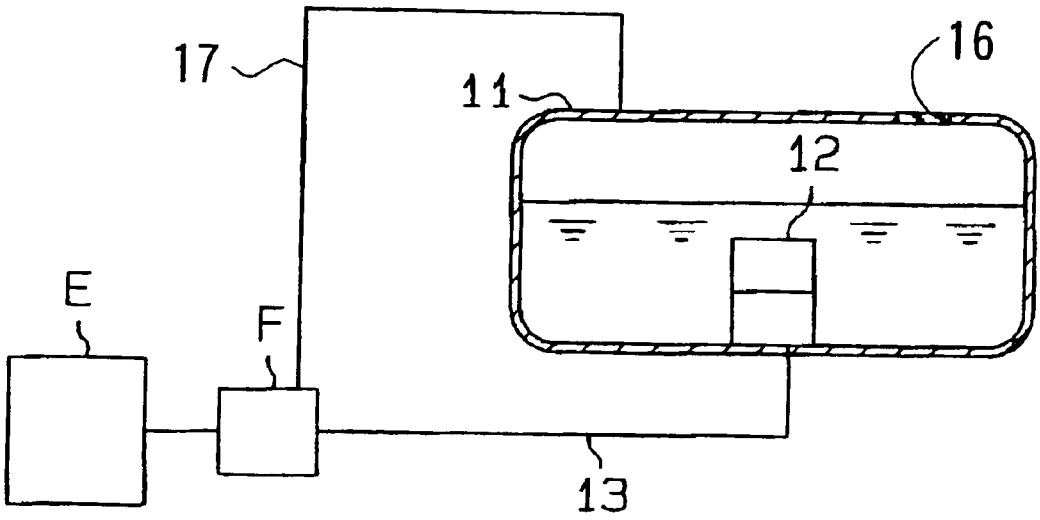
FIG. 2 is a block diagram of a fluid fuel supply system according to the first embodiment of the present invention.

As shown in FIG. 1, a housing of the fuel pump 12 includes a center housing 21, a motor housing 22 and a base housing 23. The motor housing 22 is secured by bolts to the upper end of the center housing 21. The base housing 23 is secured by bolts to the lower end of the center housing 21. The bolts are not shown in the drawing.

A through hole 11A is formed through the fuel tank 11. An annular mounting base 11B is welded to the through hole 11A of the fuel tank 11. The fuel pump 12 is secured to the fuel tank 11. The base housing 23 of the fuel pump 12 is secured to the mounting base 11B of the fuel tank 11 by bolts, which are not shown in the drawing. A gasket 15 is interposed between an upper surface of a flange 23A formed around an outer periphery of the base housing 23 and the mounting base 11B so as to seal a gap therebetween. The fuel pump 12 is placed in the fuel tank 11 in a manner that the lower end of the base housing 23 being exposed outside the fuel tank 11. A space outside the housing of the fuel pump 12 and in the fuel tank 11 is a fuel reserving chamber or a fluid reserving chamber of the fuel tank 11.

A pump chamber 24 is defined in the center housing 21. A motor chamber 25 is defined in the motor housing 22. The motor chamber 25 is disposed vertically above the pump chamber 24. The pump chamber 24 and the motor chamber 25 are partitioned by a center block 26 in the center housing 21 and are interconnected by a communication passage 26A. The communication passage 26A located adjacent the upper side of the pump chamber 24 functions as a bleeding port for bleeding the DME in the pump chamber 24 to the motor chamber 25.

The pump chamber 24 communicates with the outside of the housing or the fuel reserving chamber through a communication passage 21A which is formed in the center housing 21. The communication passage 21A is located adjacent to the lower or bottom side of the pump chamber 24. The communication passage 21A also interconnects an introducing port 24A for introducing the DME in the fuel reserving chamber into the pump chamber 24 and an opening 21B located adjacent to the introducing port 24A.

A drive shaft 27 is rotatably supported in the housing so as to extend through the pump chamber 24, the communication passage 26A and the motor chamber 25. Even if the drive shaft 27 is inserted through the communication passage 26A, a clearance between the drive shaft 27 and the communication passage 26A is maintained to interconnect the pump chamber 24 and the motor chamber 25.

The upper end of the drive shaft 27 is supported in the motor housing 22 by a ball bearing 28 fitted in a mounting hole or a bleeding port 22A which is located adjacent to the upper side of the motor chamber 25. The motor chamber 25 communicates with the outside of the housing or the fuel reserving chamber through the mounting hole 22A. The lower end of the drive shaft 27 is supported by a bearing 29 fitted in a mounting recess 23B which is formed in the base housing 23.

A motor mechanism 30 is arranged in the motor chamber 25. The motor mechanism 30 in the motor chamber 25 includes a stator 31 that is secured to an inner circumferential surface of the motor housing 22. The motor mechanism 30 also includes a rotor 32 that is secured to the drive shaft 27 in the motor chamber 25 and is located to face the stator 31. The motor mechanism 30 is configured to drive the drive shaft 27 in accordance with the rotation of the rotor 32 by an electric current supplied from an outside to the stator 31.

An axial piston pump mechanism 33 is arranged in the pump chamber 24. The piston pump mechanism 33 includes a cylinder block 34 that engages the drive shaft 27 by means of spline engagement to rotate integrally with the drive shaft 27. The cylinder block 34 includes a plurality of cylinder bores 34A around the drive shaft 27. Two cylinder bores are illustrated in FIG. 1. The pump mechanism 33 and the motor mechanism 30 correspond to a heat generating mechanism.

A piston 35 is accommodated in each cylinder bore 34A so as to reciprocate therein. A cam surface 26B is formed on the center block 26 and is at a predetermined angle with respect to an axial direction of the drive shaft 27. A shoe 36 is slidable to face the cam surface 26B and is coupled to each piston 35 through a ball coupling 37.

The bottom end of the pump chamber 24 is defined by a part of the upper end surface of the base housing 23. A valve port forming plate 38 is fixed to the upper end surface of the base housing 23. The upper end surface of the valve port forming plate 38 and the lower end surface of the cylinder block 34 are slidable to each other with the surfaces contacting to each other.

A suction port 38A and a discharge port 38B each are formed in the valve port forming plate 38. The suction port 38A and the discharge port 38B respectively have an opening at the upper side and the lower side of the valve port forming plate 38. An inlet 11C is formed in the mounting base 11B, and a suction passage 23C is formed in the base housing 23. The suction passage 23C communicates the inlet 11C with the suction port 38A. The inlet 11C is located near the lowest position of the fuel reserving chamber. The supply conduit 13 as shown in FIG. 2 is connected to the discharge port 38B at an outlet 23D formed in the base housing 23.

A chamber 34B is defined near the center of the cylinder block 34. A coil spring 39 is in the chamber 34B and surrounds the drive shaft 27. The urging force of the coil spring 39 is applied to the cylinder block 34 through a spring seat 40 fixed to the cylinder block 34 and is also applied to a shoe retainer 44 through a spring seat 41, a pin 42 and a pivot 43. The shoe retainer 44 engages the shoe 36, and the shoe 36 is pressed against the cam surface 26B by the urging force applied to the shoe retainer 44. The cylinder block 34 is pressed against the valve port forming plate 38 by the urging force applied to the spring seat 40.

As the cylinder block 34 rotates integrally with the drive shaft 27, each piston 35 reciprocates within a predetermined stroke distance as it is regulated by an inclination angle of the cam surface 26B. Each cylinder bore 34A alternately communicates with the suction port 38A and the discharge port 38B of the valve port forming plate 38. Accordingly, the DME in the fuel reserving chamber is introduced into the cylinder bores 34A through the inlet 11C, the suction passage 23C and the suction port 38A, and the DME in the cylinder bores is subsequently discharged through the discharge port 38B by pumping action. The discharged DME is sent to the fuel injection device F through the outlet 23D and the supply conduit 13.

As the motor mechanism 30 drives the piston pump mechanism 33, heat is generated by friction at each sliding portion of the piston pump mechanism 33, and by the rotation of the motor mechanism 30. The generated heat heats the DME in the pump chamber 24 and the motor chamber 25. Due to the heating, the DME flows from the lower side toward the upper side in the chambers 24 and 25 by an upward convection current of the heated DME and the vaporized DME bubbles.

Due to the above-mentioned flow, the DME in the fuel reserving chamber is introduced into the pump chamber 24 through the opening 21B, the communication passage 21A and the introducing port 24A. The DME in the pump chamber 24 is subsequently further introduced into the motor chamber 25 through the communication passage 26A. The DME in the motor chamber 25 passes through the clearance between the stator 31 and the rotor 32 of the motor mechanism 30 and finally returns to the fuel reserving chamber through the clearance in the ball bearing 28, and the mounting hole 22A. Due to the above-described flow of DME, the piston pump mechanism 33 and the motor mechanism 30 are effectively cooled.

In the present constitution, since the DME in the fuel tank 11 is heated and vaporized due to the heat generated by the piston pump mechanism 33 and the motor mechanism 30, the pressure in the fuel tank 11 increases. Due to the increased pressure, the minimum pressure in the cylinder bores 34A increases in a suction cycle of the piston pump mechanism 33. Accordingly, a differential between the maximum pressure in the cylinder bores 34A and the minimum pressure reduces, and the maximum pressure is substantially the same as the DME discharged pressure. Consequently, load applied to the piston pump mechanism 33 also reduces.

According to the first preferred embodiment, the following advantageous effects are obtained.

(1) The DME in the fuel reserving chamber of the fuel tank 11 is introduced into the pump chamber 24 through the introducing port 24A and is returned to the fuel reserving chamber through the communication passage 26A. The communication passage 26A is located above the upper side of the pump chamber 24, and the mounting hole 22A, which is located adjacent to the upper side of the motor chamber 25. The above flow of DME occurs due to heat that is generated by the piston pump mechanism 33 and the motor mechanism 30. The communication passage 26A and the mounting hole 22A are respectively located above the pump chamber 24 and the motor chamber 25. Thus, the DME is effectively bled outside the housing through the communication passage 26A and the mounting hole 22A and is returned to the fuel reserving chamber. The above-described DME flow desirably cools the piston pump mechanism 33 and the motor mechanism 30. Because of the above-described relative location of the communication passage 26A and the mounting hole 22A, the DME bubbles hardly stay in the chambers 24 and 25. By the upward current of the DME bubbles, some of the DME flow is also generated.

(2) The introducing port 24A is located near the bottom of the pump chamber 24. The DME is introduced into the lower side of the pump chamber 24 and is bled toward the upper side. Namely, the DME in the pump chamber 24 readily flows in an upward direction. Accordingly, the cooling efficiency improves in the pump chamber 24.

(3) In the present embodiment, the motor chamber 25 is located above the pump chamber 24, and the DME in the pump chamber 24 is introduced into the motor chamber 25 through the communication passage 26A located near the lower side of the motor chamber 25. Namely, the DME is introduced from the lower side of the motor chamber 25 and is bled from the upper side. Accordingly, the cooling efficiency in the motor chamber 25 improves.

(4) The DME introduced into the pump chamber 24 through the introducing port 24A is returned to the fluid reserving chamber through the motor chamber 25 in accordance with the flow due to the heat that is generated in the pump chamber 24 and the motor chamber 25. Since the motor chamber 25 is disposed above the pump chamber 24 in a substantially vertical direction, the DME from the pump chamber 24 readily flows toward the motor chamber 25. As a result, the DME readily flows through both the pump chamber 24 and the motor chamber 25.

(5) The introducing port 24A communicates with the opening 21B that is located adjacent to the introducing port 24A on the outer circumferential wall of the housing. In comparison to an introducing port that communicates with an opening that is remotely located from the introducing port on an outer circumferential wall of a housing, a path interconnecting the introducing port 24A and the opening 21B is relatively short. Consequently, upon introducing the DME into the housing, the DME receives relatively a small amount of resistance in the short path. Namely, the DME is effectively introduced with the small resistance.

(6) The entire housing is substantially accommodated in the fuel tank 11. Thereby, the fuel pump 12 is assembled in the fuel tank 11 almost without protruding from the fuel tank 11. Additionally, the fuel pump 12 is cooled by the DME in the fuel tank 11 in the outside of the housing.

(7) The communication passage 26A and the mounting hole 22A are located to sandwich the motor mechanism 30. The DME introduced into the motor chamber 25 through the communication passage 26A passes through the clearance between the stator 31 and the rotor 32 toward the mounting hole 22A. Thus, cooling efficiency of the motor mechanism 30 improves.

(8) The axial piston pump mechanism 33 is employed as a pump mechanism. As compared with other pump mechanisms such as a gear type pump mechanism, volumetric efficiency improves.

A second preferred embodiment of the present invention will now be described in reference to FIG. 3. The second preferred embodiment of the fuel pump 12 includes the chambers 24 and 25 of the first preferred embodiment that are arranged in a substantially horizontal manner. An introducing port 25A is arranged adjacent to the motor chamber 25. The other components are substantially the same to those of the first embodiment. The same reference numerals in the second embodiment denote the corresponding components in the first embodiment, and the description of the substantially identical components is omitted.

Figure 3:
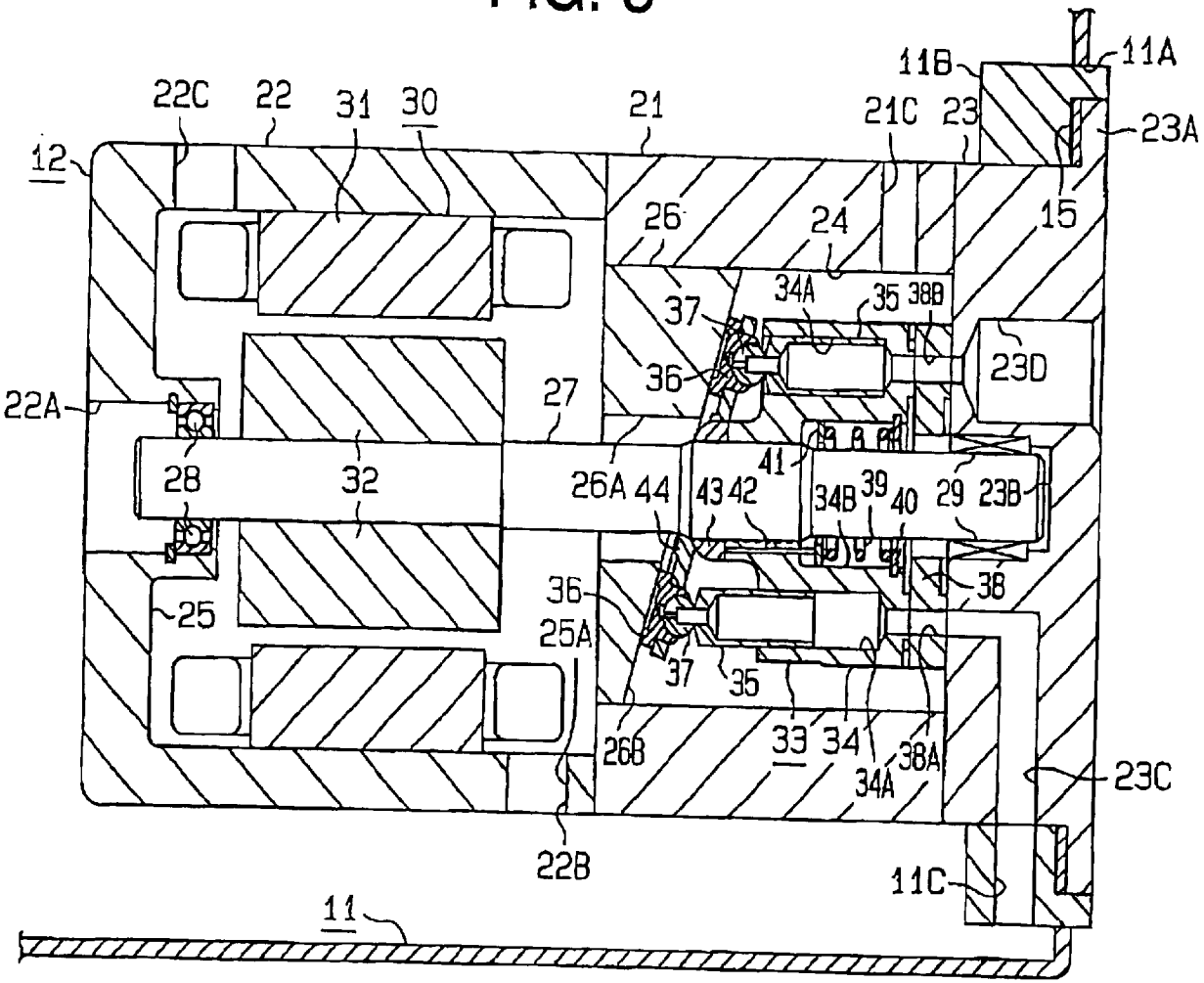
FIG. 3 is a schematic cross-sectional view of a fuel pump according to a second embodiment of the present invention.

As shown in FIG. 3, the fuel pump 12 in the present embodiment is secured to the mounting base 11B that is fixed to the side wall of the fuel tank 11 near the bottom of the fuel tank 11. The pump chamber 24 and the motor chamber 25 are disposed in a substantially horizontal manner in the fuel pump 12. Namely, the fuel pump 12 of the first embodiment is tilted approximately by 90 degrees to horizontal in the second embodiment. In other words, the fuel pump 12 of the second preferred embodiment is located in such an orientation that the inlet 11C and the introducing port 25A faces the bottom surface of the fuel tank 11.

The introducing port 25A for introducing the DME from the fuel reserving chamber into the motor chamber 25 is located on the lower or bottom side of the motor chamber 25 and near the center block 26 that divides the motor chamber 25 and the pump chamber 24. The introducing port 25A includes an opening 22B on the circumferential surface of the housing.

A bleeding passage or port 22C is defined above the upper or top side of the motor chamber 25 and near the left end of the motor mechanism 30 away from the center block 26. Another bleeding passage or port 21C is located above the pump chamber 24 and near the base housing 23.

In the second preferred embodiment, due to the flow of DME by heat from the piston pump mechanism 33 and the motor mechanism 30, the DME in the fuel reserving chamber is introduced into the motor chamber 25 through the opening 22B and the introducing port 25A. Some of the DME introduced in the motor chamber 25 passes through the clearance between the stator 31 and the rotor 32 of the motor mechanism 30 and returns to the fuel reserving chamber through the bleeding passage 22C. Since the mounting hole or another bleeding port 22A interconnects the motor chamber 25 and the fuel reserving chamber, yet some of the DME passes through the clearance between the stator 31 and the rotor 32 and returns to the fuel reserving chamber through the mounting hole 22A.

The rest of the DME introduced into the motor chamber 25 through the opening 22B and the introducing port 25A is introduced into the pump chamber 24 through the communication passage 26A and is returned to the fuel reserving chamber through the bleeding passage 21C.

According to the second preferred embodiment, in addition to the advantageous effects as mentioned in the paragraph (1), (2), (5) through (8) of the first preferred embodiment, the following advantageous effects are obtained.

(9) In the second preferred embodiment, the pump chamber 24 and the motor chamber 25 are arranged in a substantially horizontal manner in the fuel pump 12. In contrast, in the first preferred embodiment, the chambers 24 and 25 are arranged in a substantially vertical manner in the fuel pump 12. In comparison to the first preferred embodiment, the fuel pump 12 is reduced in the vertical height in the second preferred embodiment. Accordingly, the necessary amount of DME is reduced to cover the housing in the fluid reserving chamber in the second preferred embodiment. Namely, the chambers 24 and 25 are relatively filled with the reduced amount of DME.

(10) The pump chamber 24 and the motor chamber 25 are divided by the center block 26 and are interconnected by the communication passage 26A. The introducing port 25A is located near the center block 26 in the motor chamber 25. As comparison to the first preferred embodiment in which the introducing port is remotely located from the center block 26, the DME is readily introduced into both the chambers 24 and 25 through the centrally located introducing port 25A of the second preferred embodiment.

A third preferred embodiment of the present invention will now be described with reference to FIG. 4. In the third embodiment, the fuel pump 12 is assembled in the fuel tank 11 in a such manner that the housing of the fuel pump 12 is placed substantially outside the fuel tank 11. The locations of the introducing port and the bleeding passage are changed from those of the first embodiment. The other components are substantially the same to those of the first embodiment. Accordingly, the same reference numerals in the third embodiment denote the substantially identical components of the first embodiment and the description of the similar components is omitted.

Figure 4:
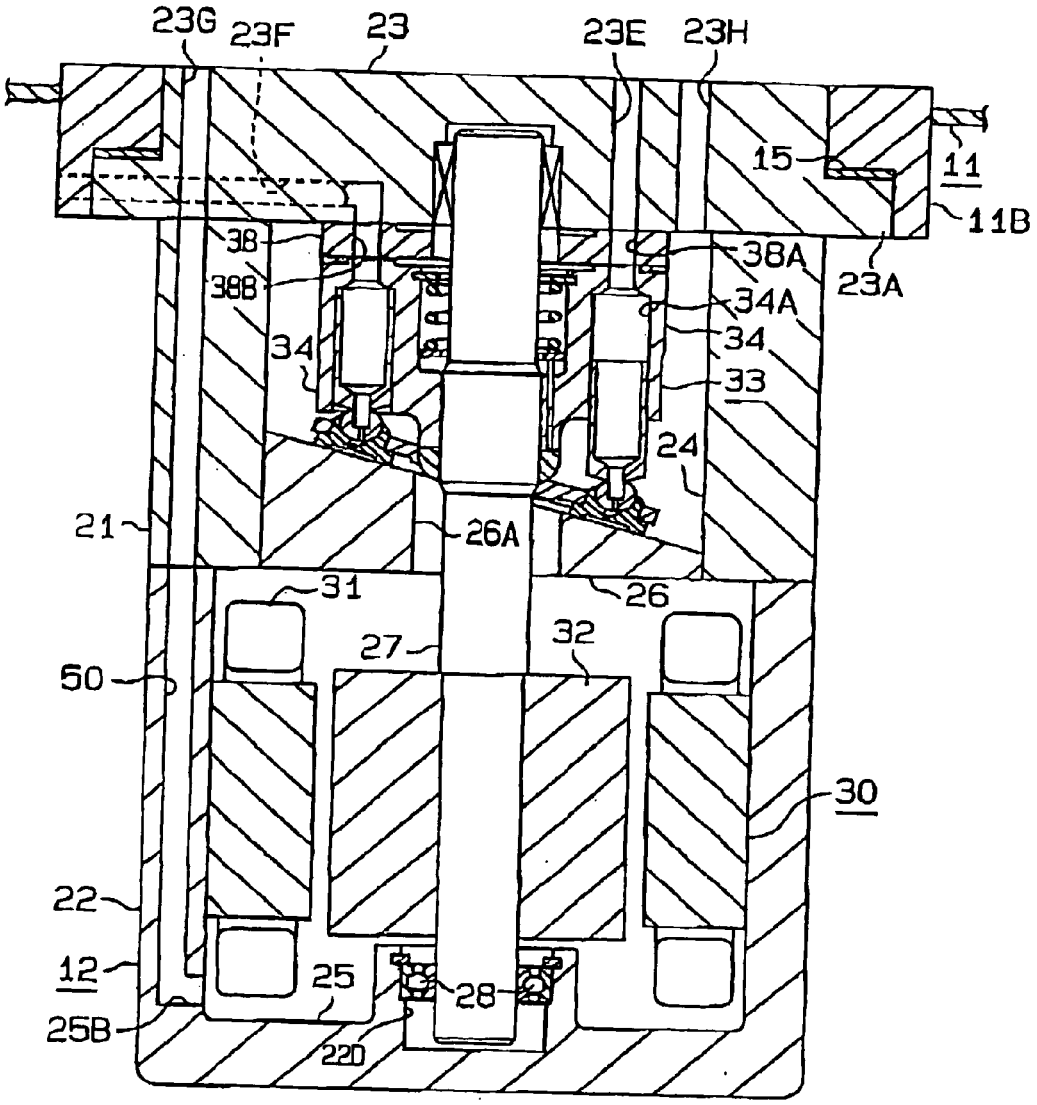
FIG. 4 is a schematic cross-sectional view of a fuel pump according to a third embodiment of the present invention.

As shown in FIG 4, in the third preferred embodiment, the fuel pump 12 is fixed to the bottom of the fuel tank 11 such that the fuel pump 12 of the first embodiment is vertically inverted. That is, the pump chamber 24 is located above the motor chamber 25. The center housing 21 is secured to the lower end of the base housing 23, and the motor housing 22 is secured to the lower end of the center housing 21.

The DME in the fuel reserving chamber is introduced into the cylinder bore 34A through a suction passage 23E and the suction port 38A. Subsequently, the DME is supplied to the fuel injection device F through the discharge port 38B and a discharge passage 23F.

An introducing port 25B is located near the bottom of the motor chamber 25 in the motor housing 22. The introducing port 25B communicates with an opening 23G that is formed by the base housing 23 and faces the fuel reserving chamber. A communication passage 50 extends within the housings 22, 21 and 23 from the opening 23G to the introducing port 25B. The pump chamber 24 communicates with the fuel reserving chamber through a bleeding passage or port 23H that is formed in the base housing 23, which is the upper side of the pump chamber 24.

In the third preferred embodiment, the ball bearing 28 supports one end of the drive shaft 27 near the motor mechanism 30. The ball bearing 28 is fitted in a mounting recess 22D that is defined in the motor housing 22 without the mounting hole 22A of the first preferred embodiment. In the third preferred embodiment, due to the heat from the piston pump mechanism 33 and the motor mechanism 30, the DME flows from the fuel reserving chamber into the motor chamber 25 through the opening 23G, the communication passage 50 and the introducing port 25B. The DME in the motor chamber 25 then flows into the pump chamber 24 through the communication passage 26A. The DME is finally returned to the fuel reserving chamber through the bleeding passage 23H.

According to the third preferred embodiment, in addition to the advantageous effects as mentioned in the paragraphs (1) through (3), (7) and (8), the following advantageous effects are obtained.

(11) The fuel pump 12 is assembled into the bottom of the fuel tank 11 in such a manner that the fuel pump 12 is placed substantially outside the fuel tank 11. Because of the above relative position, even if the fuel reserving chamber contains a little amount of DME, the pump chamber 24 and the motor chamber 25 are readily filled with the DME. Since the pump chamber 24 and the motor chamber 25 are usually filled with the DME that circulates for cooling, the piston pump mechanism 33 and the motor mechanism 30 are effectively maintained at a desirable temperature.

(12) In the third preferred embodiment, since the fuel pump 12 is located substantially outside the fuel tank 11, the capacity in the fuel reserving chamber is larger than that of the first preferred embodiment in which the fuel pump 12 is located substantially inside the fuel tank 11.

The present invention is not limited to the above-described embodiments but may be modified into the following alternative embodiments.

In the first preferred embodiment, the DME in the motor chamber 25 is bled to outside the housing through the mounting hole 22A. However, in an alternative embodiment the DME may be bled to outside the housing through another hole or a bleeding passage defined near the upper side of the motor chamber 25.

In the first preferred embodiment, the introducing port 24A does not require to be located near the lower side of the pump chamber 24. For example, in an alternative embodiment the introducing port 24A may be located near the center block 26 or the upper side of the pump chamber 24.

In an alternative embodiment, a check valve is placed in either one of the communication passage 21A, the opening 21B and the introducing port 24A to permit the DME to flow from the fuel reserving chamber to the pump chamber 24 and to block the DME to flow from the pump chamber 24 to the fuel reserving chamber. In other words, the DME in the pump chamber 24 does not flow to the fuel reserving chamber through the introducing port 24A, the communication passage 21A and the opening 21B. Therefore, for example, even if the housing is exposed above the liquid level of the DME as the DME level decreases in the fuel reserving chamber, the pump chamber 24 and the motor chamber 25 are readily filled with the DME that circulates for cooling, and the piston pump mechanism 33 and the motor mechanism 30 are effectively is maintained at a desirable temperature.

In the second preferred embodiment, the introducing port 25A is remotely located from the boundary between the pump chamber 24 and the motor chamber 25. For example, in an alternative embodiment the introducing port 25A is located at the opposite side of the center block 26 relative to the motor mechanism 30.

In an alternative embodiment for the second preferred embodiment, the introducing port 25A and the opening 22B are omitted, and the DME in the fuel reserving chamber is introduced into the motor chamber 25 through the mounting hole 22A. In the above alternative embodiment, the mounting hole 22A corresponds to an introducing port adjacent to the motor chamber 25.

In the third preferred embodiment, the fuel pump 12 is arranged substantially outside the fuel tank 11, and the pump chamber 24 is located above the motor chamber 25. In an alternative embodiment, the fuel pump 12 is arranged substantially outside the fuel tank 11. However, the chambers 24 and 25 are disposed in a substantially horizontal manner.

In alternative embodiments to the above preferred embodiments, a filter is placed at the opening that communicates with the introducing port and that is defined on the outer circumferential surface of the housing. The filter prevents foreign substances from flowing into the housing.

In alternative embodiments to the above preferred embodiments, the cylinder block 34 and the piston 35 are respectively made of aluminum and iron. Aluminum has a higher thermal expansion coefficient than iron. In these embodiments, as temperature increases, the clearance between the cylinder block 34 and the piston 35 increases due to the above difference in thermal expansion coefficient. On the other hand, the lack of the difference in thermal expansion coefficient causes insufficient clearance at a high temperature and leads to undesirable seizure between the two components. For the above reasons, in the alternative embodiments, even if a predetermined clearance between the cylinder block 34 and the piston 35 is relatively small at a room temperature, seizure between the above two components will be sufficiently prevented at a higher temperature. To ensure relatively high efficiency of operation of the piston pump mechanism 33, the clearance is preferably 10 $\mu$m or below.

In alternative embodiments to the above preferred embodiments, sliding regions are optionally coated with frictional resistance reducing material such as fluororesin. The sliding regions include areas between the cylinder block 34 and the valve port forming plate 38, and between the piston 35, 37 and the shoe 36, and between the shoe 36 and the cam surface 26B of the center block 26. Thereby, seizure is effectively prevented in the sliding regions. In the piston pump mechanism 33, since pressure of a liquid coat of the DME prevents sliding resistance at the sliding regions from increasing, frictional resistance reducing material itself hardly abrades.

In alternative embodiments to the above preferred embodiments, a sliding region between the cylinder block 34 and the piston 35 is coated with frictional resistance reducing material such as nickel plating or tin plating.

In alternative embodiments to the above preferred embodiments, each sliding region of the bearings 28 and 29 is coated with frictional resistance reducing means such as nickel plating and tin plating.

In alternative embodiments to the above preferred embodiments, instead of the axial piston pump mechanism 33, a piston pump employs other mechanisms such as a radial piston pump mechanism, a gear pump mechanism, a centrifugal pump mechanism, a screw pump mechanism and a roots pump mechanism.

In alternative embodiments to the above preferred embodiments, freon (chlorofluorocarbon) or propane is employed as fluid that has higher saturation pressure than atmospheric pressure at room temperature.

Therefore, the present examples and embodiments are to be considered as illustrative and not restrictive, and the invention is not to be limited to the details given herein but may be modified within the scope of the appended claims.

What is claimed is:

1. A pump for exerting pressure on fluid that has higher saturation pressure than atmospheric pressure at room temperature in a fluid reserving chamber in a fluid tank, the pump being attached to the fluid tank, the pump comprising:

a housing defining a pump chamber, a motor chamber and a communication passage between the pump chamber and the motor chamber the housing including:

at least one introducing port in the housing opening to the fluid reserving chamber for directly introducing the fluid from the fluid reserving chamber into the housing; and a bleeding port in the housing opening to the fluid reserving chamber and located above the introducing port for returning the fluid from the housing to the fluid reserving chamber; and the pump further comprising a heat generating mechanism located in the housing, wherein the fluid circulates due to a thermal flow of the fluid into the housing through the introducing port and out of the housing through the bleeding port for substantially reducing the temperature in the housing.

2. The pump according to claim 1, wherein the introducing port is located on the housing near a bottom portion of the pump chamber.

3. The pump according to claim 1, wherein the introducing port opens to a bottom portion of the motor chamber.

4. The pump according to claim 1, wherein the introducing port connects the fluid reserving chamber and the pump chamber in a minimal distance for reducing flow resistance of the fluid.

5. The pump according to claim 1, wherein the housing is accommodated substantially in the fluid tank.

6. The pump according to claim 1, wherein the pump chamber and the motor chamber are disposed in a substantially vertical manner, and the introducing port is provided only near a bottom of the housing.

7. The pump according to claim 1, wherein the pump chamber and the motor chamber are arranged laterally along the bottom surface of the fluid tank.

8. The pump according to claim 7, wherein the introducing port is located closer to a boundary between the pump chamber and the motor chamber than an opposite end of the motor chamber or the pump chamber, the bleeding port being spaced apart from the boundary, the fluid in each of the chamber returning to the fluid reserving chamber through the bleeding ports.

9. The pump according to claim 1, wherein the heat generating mechanism is a pump mechanism that includes an axial piston type pump mechanism.

10. The pump according to claim 1, wherein the heat generating mechanism is a motor mechanism.

11. The pump according to claim 1, wherein the heat generating mechanism is a pump mechanism that includes a cylinder block made of aluminum and a piston made of iron.

12. The pump according to claim 11, wherein a clearance between the cylinder block and the piston is approximately 10 $\mu$or below at room temperature.

13. The pump according to claim 11, wherein a sliding region between the cylinder block and the piston is coated with frictional resistance reducing material that is nickel plating.

14. The pump according to claim 1, wherein the fluid is dimethylether.

15. The pump according to claim 1, wherein the pump chamber is located above the motor chamber.

16. The pump according to claim 1, wherein the motor chamber is located above the pump chamber.

17. A pump for exerting pressure on fluid that has higher saturation pressure than atmospheric pressure at room temperature in a fluid reserving chamber in a fluid tank, the pump being attached to the fluid tank, the pump comprising:

a housing defining a pump chamber, a motor chamber and a communication passage between the pump chamber and the motor chamber;

an introducing port opening to the fluid reserving chamber and located in the housing for directly opening the fluid into the pump chamber;

a pump mechanism located in the pump chamber for exerting pressure on the fluid, the pump mechanism generating heat;

a motor mechanism located in the motor chamber for driving the pump mechanism, the motor mechanism generating heat; and a bleeding port in the house opening to the fluid reserving chamber and located above the introducing port for returning the fluid due to a thermal flow of the fluid from the motor chamber to the fluid reserving chamber, the fluid carrying the heat.

18. The pump according to claim 17, wherein the motor chamber is located above the pump chamber.

19. A fluid tank unit comprising:

a fluid tank having a fluid reserving chamber for reserving fluid that has higher saturation pressure than atmospheric pressure at room temperature; and a pump for exerting pressure on the fluid attached to the fluid tank, the pump comprising:

a housing defining a pump chamber, a motor chamber and a communication passage between the pump chamber and the motor chamber, the housing including:

at least one introducing port in the housing opening to the fluid reserving chamber for directly introducing the fluid from the fluid reserving chamber into the housing; and a bleeding port in the housing opening to the fluid reserving chamber and located above the introducing port for returning the fluid from the housing to the fluid reserving chamber; and the fluid tank unit further comprising a heat generating mechanism located in the housing, wherein the fluid circulates due to a thermal flow of the fluid into the housing through the introducing port and out of the housing through the bleeding port for substantially reducing the temperature in the housing.

20. The fluid tank unit according to claim 19, wherein the housing is accommodated substantially inside the fluid tank.

21. The fluid tank unit according to claim 19, wherein the housing is located substantially outside the fluid tank.

22. The fluid tank unit according to claim 19, wherein the introducing port is located in the housing for introducing the fluid into the pump chamber, the heat generating mechanism includes:

a pump mechanism located in the pump chamber for exerting pressure on the fluid; and a motor mechanism located in the motor chamber for driving the pump mechanism, and the bleeding port is located above the introducing port for returning the fluid from the motor chamber to the fluid reserving chamber, the fluid carrying the heat.

23. The fluid tank unit according to claim 19, wherein the fluid is dimethylether.

* * * * *